United States Patent [19]

Kemper

[11] 4,032,995

[45] July 5, 1977

[54] SYSTEM AND METHOD FOR TREATING HUMAN WASTE

[75] Inventor: James M. Kemper, Sherman Oaks, Calif.

[73] Assignee: Monogram Industries, Inc., Santa Monica, Calif.

[22] Filed: Feb. 23, 1976

[21] Appl. No.: 660,645

[52] U.S. Cl. ..... 4/10; 4/115; 210/152; 210/194; 210/167

[51] Int. Cl.[2] ..... E03D 1/00; E03D 3/00; E03D 5/00

[58] Field of Search ..... 4/10, 8, 9, 76, 77, 4/79, 80, 89, 90, 95; 210/149, 181, 152, 194, 177, 206, 220, 260, 257, 167, 196

[56] References Cited

UNITED STATES PATENTS

| | | | |
|---|---|---|---|
| 2,768,386 | 10/1956 | Graef et al. | 4/131 |
| 3,228,036 | 1/1966 | Zaska et al. | 4/77 |
| 3,563,384 | 2/1971 | Delaney et al. | 4/10 |
| 3,699,592 | 10/1972 | Minchak | 4/90 |
| 3,713,177 | 1/1973 | Tufts et al. | 4/115 X |
| 3,873,445 | 3/1975 | Bussard | 4/10 X |
| 3,950,249 | 4/1976 | Egar et al. | 4/10 X |

*Primary Examiner*—Henry K. Artis
*Attorney, Agent, or Firm*—Poms, Smith, Lande & Glenny

[57] ABSTRACT

A toilet system for use on vehicles, such as railroad trains and boats, wherein the toilet contents are chlorinated and ground into a slurry of a predetermined size prior to pumping out. The system includes a grinder which recirculates the toilet contents through the grinder for a predetermined period of time. The system cannot operate until a chlorine tablet has been inserted into the toilet. A timer may be provided which shuts off the grinder after the aforementioned period of time. A valve may be provided in the system which can be activated to pump out the ground chlorinated contents of the toilet while grinding the same and will run until the holding tak of the toilet is emptied. The macerated and chlorinated waste treated in this system requires a relatively low amount of chlorine and has a bacteria count so low that the ground and chlorinated waste may be dumped in situ, such as along railroad tracks or in a harbor or the like.

10 Claims, 3 Drawing Figures

SYSTEM AND METHOD FOR TREATING HUMAN WASTE

BACKGROUND OF THE INVENTION

1. Field of the Invention

The invention relates to human waste treatment systems; and more particularly, to a system and method for chlorinating and macerating human waste in a manner permitting disposal in situ, as into a body of water or along railroad tracks or the like.

2. Description of the Prior Art

All railroad trains and commercial vehicles, such as buses and aircraft, use recirculating chemical toilets. These toilets cannot be emptied into bodies of water or along railroad tracks or highways since such chemicals used therein only mask the odor of the contents and retard, but do not kill, bacteria. All of these toilets must be emptied into a city sewage system of the like. Such a means of disposal in unsanitary and requires special handling and equipment.

SUMMARY OF THE INVENTION

It is an object of this invention to provide an improved system and method for treating human waste for subsequent disposal thereof.

It is a further object of this invention for treating human waste in a manner permitting on site disposal from a vehicle, boat or the like.

It is still another object of this invention to provide a system for treating human waste in a manner reducing the waste to a particular size and having a low bacteria count using relatively low quantities of chemicals.

These and other objects are preferably accomplished by providing a toilet having a holding tank wherein the waste is macerated by a macerator pump which is only activated when the presence of a tablet of dry concentrated chlorine is introduced into the waste in the holding tank. The system may also be inoperative unless the presence of waste to a predetermined level is detected in the holding tank. The system is capable of either introducing water into said toilet for flushing the same, macerating waste from said holding tank and recirculating it back into the toilet or pumping chemically treated macerated waste from the macerator pump to a remote location for disposal in situ, if desired.

DESCRIPTION OF THE PREFERRED EMBODIMENT

Figure 1:
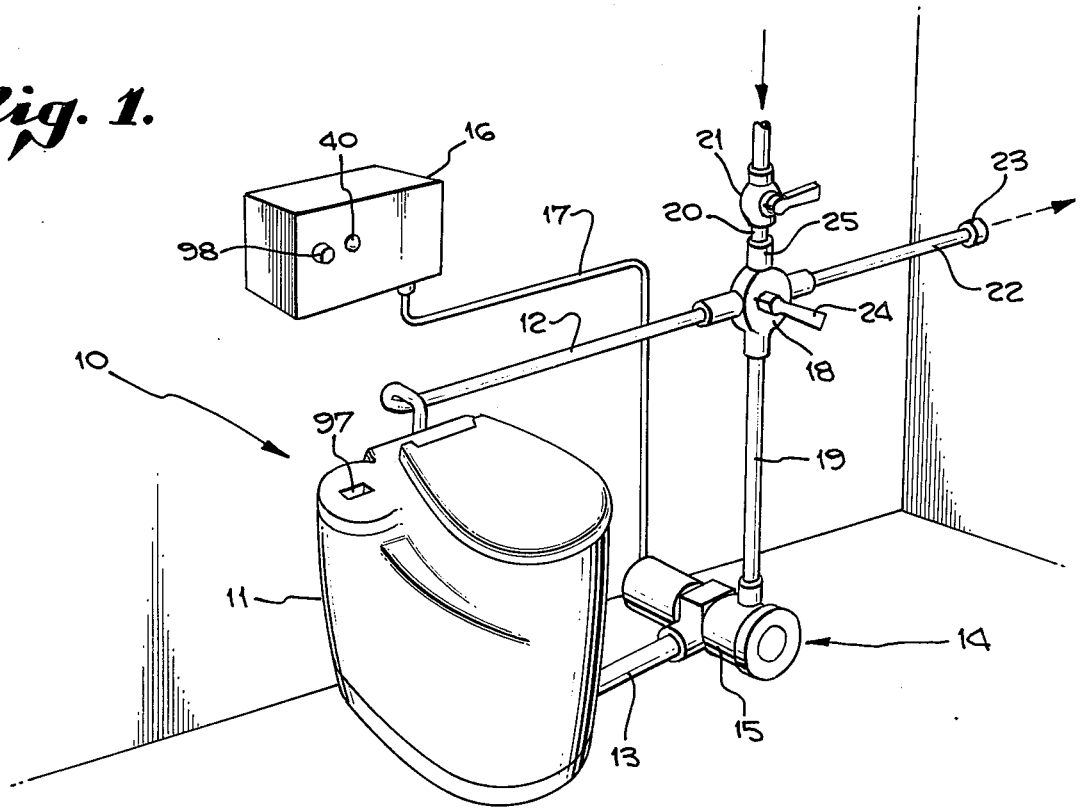
FIG. 1 is a perspective view of a chlorinator macerator system for a toilet in accordance with the teachings of the invention.

Referring now to FIG. 1 of the drawing, a toilet system 10 is shown having a recirculating chemical toilet 11 having a waste discharge through outlet 13 in fluid communication with a holding tank (not visible) forming the bottom of the toilet for withdrawing waste therefrom as is also well known in the toilet art.

As particularly contemplated in the present invention, macerating and chlorinating means 14 are provided for both macerating human waste and foreign materials therein withdrawn from toilet 11 through outlet 13 and chlorinating the same prior to on site disposal thereof. In the exemplary embodiment of the invention, such macerating and chlorinating means 14 includes a recirculation inlet 12 leading into toilet 11 and a macerator and pump 15 having its inlet in fluid communication with outlet 13 and a control box 16 operatively connected, via conduit 17, to macerator and pump 15. The outlet of macerator and pump 15 is in fluid communication with a valve 18 via conduit 19. Valve 18 has one inlet in fluid communication with a conduit 20 leading to a source of water. A manually controlled one-way, shut-off valve 21 optionally may be disposed in conduit 20 for selectively admitting water to valve 18. One outlet of valve 18 is coupled to recirculation inlet 12 and another outlet of valve 18 is coupled to conduit 22 leading to a fitting 23 or the like which may be located at the exterior of the vessel or the like, such as the hull of a boat, for discharging macerated and chlorinated waste. The positions on valve 18 may be controlled by a selector switch 24 selectively movable between macerate, pump-out, and fresh water inlet positions as will be discussed. A vacuum breaker 25 may also optionally be disposed in conduit 20 between valve 21 and valve 18.

Figure 2:
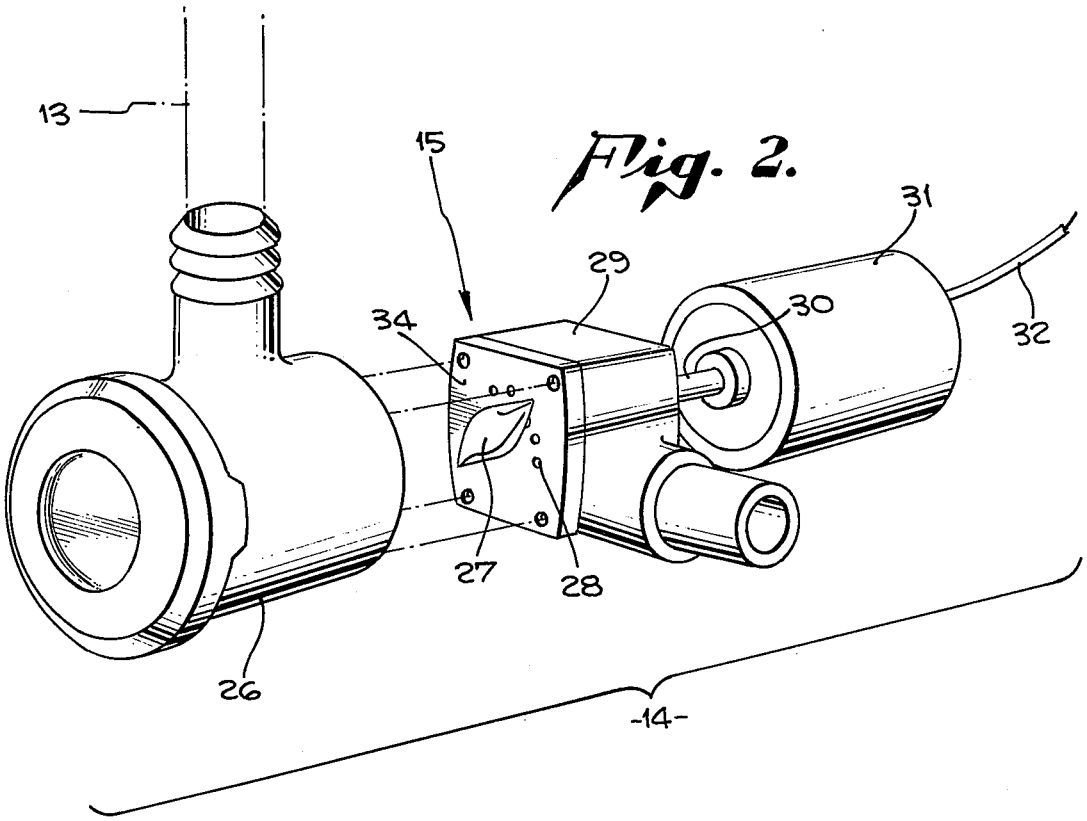
FIG. 2 is a detailed perspective view of a portion of the system of FIG. 1.

The macerator and pump 15 is shown in exploded view in FIG. 2. Waste from toilet 11 enters from outlet 13 into a collector housing 26 where the waste is sheared by a spinning cutter 27 before entering through apertures 28 into a conventional positive displacement pump 29 coupled to a motor shaft 30 driven by a conventional motor 31, such as a 12 volt D.C. motor. Suitable electrical conduits 32 are coupled to motor 31 for actuating the same leading to a suitable power source (not shown), along conduit 17, such as a battery on the vessel.

Figure 3:
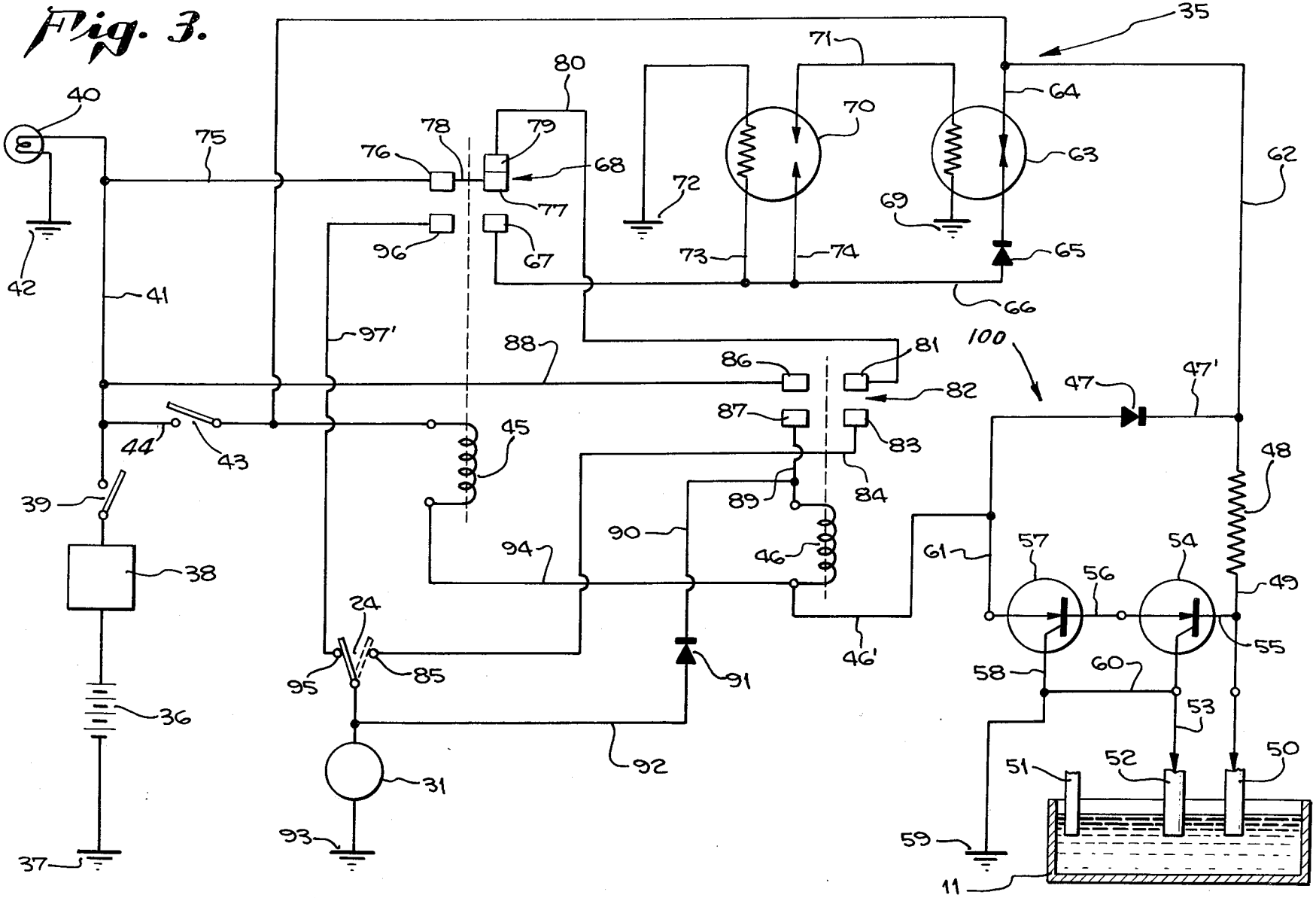
FIG. 3 is a circuit diagram for carrying out the system of FIG. 1.

FIG. 3 shows a circuit 35 which may be used to carry out the maceration and chlorination of waste in the apparatus of FIGS. 1 and 2. A suitable source of power, such as a 12 volt D.C. battery 36, which is grounded at ground 37 and may be the source of power for the vessel or vehicle in which system 10 is mounted, is operatively connected to a conventional circuit breaker 38, such as a 25 amp circuit breaker, coupled to an on-off switch 39 for system 10. Switch 39 is coupled to a light 40 (see also control box 16 in FIG. 1) via line 41 which is grounded at ground 42.

A normally open switch 43 is disposed in line 44 between line 41 and first switching means in the preferred form of a first relay 45. Relay 45 is in turn connected to second switching means in the preferred form of a second relay 46. Relay 46 is in turn coupled via line 46′ to a diode 47 which is coupled via line 47′ to a resistor 48. Resistor 48 is coupled, via line 49, to a probe 50 disposed in the holding tank forming the bottom of toilet 11 of FIG. 1. A second probe 52 is also located in the bottom or holding tank portion of toilet 11 and coupled, via line 53, to a transistor 54. Probes 50, 52 and their circuitry act as liquid sensors for circuit 35. Transistor 54 is coupled, via line 55, between resistor 48 and probe 50. Transistor 54 is also coupled, via line 56, to a second transistor 57, transistor 57 being connected via line 58 to ground 59. Line 60 interconnects ground 59 to transistor 54. Transistor 57 is also connected to line 46′ via line 61. Line 62 interconnects diode 47 and resistor 48 to line 44 when switch 43 is momentarily closed. A thermal timer 63 is also connected to line 62 via line 64 coupled to the normally closed contacts of timer 63 which contacts are in turn connected to a diode 65 which diode 65 is connected, via line 66, to contact 67 of a normally open switch 68. The heater of timer 63 is grounded at ground 69 and its heater is coupled to the normally open contacts of a second thermal timer 70 via line 71, the heater of which timer 70 is connected to both ground 72 and to line 66 via line 73. The contacts of timer 70 are also coupled to line 66 via line 74.

A line 75 is coupled to both line 41 and to a contact 76 of switch 68. Contact 76 is connected to a contact 77 via line 78, and contact 77 is adapted to engage a contact 79 coupled via line 80 to a contact 81 of a second switch 82. A second contact 83 of switch 82 is spaced from contact 81 and is connected, via line 84, to a pump-out contact 85 adapted to be engaged by valve selector switch 24 (see FIG. 1). Switch 82 includes a second set of spaced contacts 86, 87, contact 86 being connected via line 88 to line 41. Contact 87 is connected to relay 46 via line 89. Line 90 interconnects relay 46 with a diode 91, connected via line 92 to the motor 31 (FIG. 2) which is grounded at ground 93. Relay 45 is interconnected with relay 46 via line 94. A "macerator" contact 95 is also adapted to be engaged by selector switch 24 (FIG. 1) and is coupled to a contact 96, via line 97', which contact 96 is spaced from and adapted to engage contact 76 of switch 68.

All of the foregoing components, such as timers, diodes, transistors, etc. are conventional well-known electronic components and further discussion thereof is deemed unnecessary. Obviously, various circuitry may occur to one skilled in the art for carrying out the techniques of the invention.

As shown in FIG. 3, the bottom of a chute 51 is shown opening into the interior of the lower or holding tank portion of toilet 11. As shown in FIG. 1, access to chute 51 is provided by a slot 97 on the top of toilet 11. It is contemplated that a tablet of a predetermined size be inserted into slot 97 and thus into the holding tank portion via chute 51. Such a tablet should be of a sufficient shape and weight to close the spaced contacts of switch 43 which are disposed within chute 51. Thus, it is contemplated that a user of this system must use a tablet of dry chlorine which chlorine is in a highly concentrated state and closes switch 43 momentarily thereby energizing the coil of relay 45. This closes contacts 76 and 96 and contacts 67 and 77 and actuates timers 63, 70. Also, liquid sensors or probes 50, 52 are activated as long as current flows between proves 50, 52 if selector switch 24 is in its macerate position. As shown in FIG. 3, motor 31 will not run if selector switch 24 is in any other position. Motor 31 runs for a predetermined time, thus activating macerator and pump 15, then stops, as will be discussed. When motor 31 is running, current flows through line 92 to relay 46 closing contacts 86, 87 and 81, 83. Motor 31 runs until the thermal timers 63, 70 open the contacts of timer 63 breaking the current flow causing relay 45 to open contacts 76, 96 and 67, 77 thus inactivating motor 31. Relay 45 is now de-energized and contacts 77, 79 close causing current to flow to contact 81 of relay 46. Relay 46 has of course been kept energized throughout the macerating cycle and contacts 76, 96 and 67, 77 have been kept closed. Of course, during the maceration cycle, the treated waste is being circulated from grinder and pump 15, via outlet 19 (FIG. 2) into line 12 and back into toilet 11 and out outlet 13 back into grinder and pump 15 due to the position of valve switch 24 as indicated by the arrows in FIG. 1.

When motor 31 is actuated, waste from the holding tank portion of toilet 11 is drawn into the collector housing 26 whereby it contacts the rotating shear blade 27. Blade 27 is affixed to the end of motor shaft 30 which protrudes through pump 29 and plate 34, plate 34 forming a closure on the intake side of pump 29. As pump 29 is actuated, suction is achieved below the cutter plate 34 and waste is cut by blade 27 and enters pump 29 through apertures 28.

Waste is discharged out of outlet 19 as a slurry. After the contents of the holding tank of toilet 11 have been both macerated, as discussed, and chlorinated due to the insertion of the tablet into the holding tank of toilet 11, the selector switch 24 is turned to the "pump-out" position shown in dotted lines in FIG. 3. Current now flows from contact 67 of relay 46 to motor 31 which runs until holding tank portion of toilet 11 is empty. At that time, liquid level sensor 100 causes relay 46 to de-engerize thus inactivating motor 31. Due to the position of valve switch 18, macerated and treated waste from grinder and pump 15 enters outlet 19 and passes through line 22 to fitting 23 (or to another remote location).

Of course, if the level of waste in tank 51 does not reach probes 50, 52 of sensor 100, no current flows therebetween and motor 31 either will not activate or will be deactivated. Also relay 45 must then be energized by insertion of the chlorine tablet before relay 46 will energize.

It can be seen that I have disclosed a unique maceration and chlorination system which is particularly suited for use on railroad trains, boats and the like. The system chlorinates and grinds the contents of toilet 11 into a slurry that must pass through a particular sized sieve, such as a number 12 sieve, before it can be pumped out. The grinder of the macerator and pump 15 recirculates the contents of the holding tank portion of toilet 11 through the grinder of pump and macerator 15 for approximately 8 minutes. The system 10 cannot be started until a tablet, such as dry chlorine, has been inserted into the chute 51. Although a tablet or substance of another configuration suitable to bridge the gap of switch 43 may be used, conventional readily available chlorine tablets have the desired shape, weight and configuration. If a tablet of different material than chlorine was inserted, it might result in damage to the pump and macerator 15 or other components of the system. Metallic tablets of course would work but would cause considerable damage to the system 10.

Timers 63, 70 shut the motor 31 of macerator and pump 15 down after it has run for its predetermined time, such as 8 minutes. Switch 24 of valve 18 is now set to its pump-out position to activate motor 31 and remains activated until the holding tank portion is completely emptied.

The waste macerated and chlorinated as discussed above results in a slurry suitable to pass through a sieve or predetermined size, such as a number 12 sieve, and has a low bacteria count below a predetermined limit, such as less than 2 coli per 100 ml. using 1000 p.p.m. chlorine. Thus, a relatively small concentration of chlorine may be used to treat a considerable quantity of waste. The slurry size and its bacteria count is so low that it falls within limits set by pollution controls so that it can be dumped in situ, such as along railroad tracks or in any body of water, such as a harbor or the like.

In addition to an "off" position, valve 18 includes a position for introducing water, such as fresh or salt, from inlet 20 into toilet 11 for flushing the same, when valve 21 is opened.

In summary, if a chlorine tablet as discussed, is inserted into the tablet chute 51 to close the contacts of switch 43, timers 63, 70 are activated when valve switch 24 is moved to the "macerate" position and there is liquid in the holding tank 51. If switch 24 is in any other position than the "macerate" position, or if there is no liquid in the holding tank portion up to a predetermined level, the sequence will not be initiated and pump motor 31 will not be energized.

Once the timers 63, 70 have been started for their preset time interval, motor 31 will be energized during this preset time interval if valve switch 24 remains in the "macerate " position. If valve 24 is moved out of this position during this preset time, motor 31 will be deenergized.

After motor 31 has been energized for the preset time of timers 63, 70, motor 31 is deenergized and energizes again if switch 24 is moved to the "pump-out" position. Motor 31 will be energized until the liquid sensor 100 of circuit 35 signals that the holding tank portion is empty. At this time, motor 31 is deenergized and cannot be reenergized until waste is again present to a predetermined level in the holding tank portion. If the D.C. input terminals of motor 31 are inadvertently connected erroneously, the system 10 will be merely non-operational and no damage will result nor will motor 31 be energized. If motor 31 is energized with the shaft 30 locked, excessive current will result which will trip circuit breaker 38 with no resulting damage to the system 10.

It can be seen from the foregoing that I have described a system which senses the presence of tablet of a configuration sufficient to close a circuit and initiate the treatment of waste. If the substance is chlorine, waste treated as discussed hereinabove will be macerated and chlorinated in a degree sufficient to be dumped in situ in accordance with the most stringent pollution control regulations.

Although the systems has been described for treating human waste received from a toilet located on a vessel or vehicle, obviously the techniques disclosed herein may be used to treat any waste that is capable of being reduced to a slurry in accordance with the teachings of my invention.

Although I have described various electronic components, obviously other components, such as solid state components, may be substituted by one skilled in the art.

I claim:

1. In a treatment system for a toilet having a water inlet in fluid communication therewith for introducing water therein and a holding tank portion at the bottom thereof for receiving human waste deposited in said toilet and a grinder and pump activated by a motor having its inlet operatively connected and in fluid communication with said holding tank portion and its outlet leading to a point remote from said grinder and pump, said system comprising:

valving means operatively connected to both said outlet and the water inlet into said toilet for selectively introducing either water alone from a remote source through said water inlet into said toilet or waste from said grinder and pump either back into said toilet through said water inlet or to said point remote from said grinder and pump; and sensing means associated with said motor activated grinder and pump for sensing the presence of a tablet of a predetermined size, shape and weight thereby activating said motor to drive said grinder and pump.

2. In the system of claim 1 wherein said sensing means include a circuit having a pair of spaced contacts, said contacts being electrically coupled to said motor and adapted to actuate the same when closed, and said sensing means further includes tablet receiving means associated with said spaced contacts opening into said holding tank portion adapted to receive a tablet of a predetermined size, shape and weight in a manner closing said contacts thereby closing said circuit.

3. In the system of claim 2 wherein said valving means includes a selector switch operatively and electrically connected in said circuit to complete the same, said switch being movable between a first position allowing waste to be pumped from said holding tank portion and pumping said macerated human waste only to said point remote to said grinder and pump, to a second position allowing macerated human waste to flow only from said grinder and pump back into said holding tank, and to a third position allowing only water from a remote source to enter said toilet.

4. In the system of claim 3 wherein said circuit includes liquid level sensing means associated with said holding tank portion adapted to sense the level of liquid in said holding tank portion an inactivating said motor when said level falls below a predetermined level.

5. In the system of claim 3 wherein said circuit includes timing means associated with both said spaced contacts and said motor adapted to be energized when said first-mentioned sensing means senses the presence of a tablet of a predetermined size, shape and weight for activating said motor for a predetermined period of time.

6. A treatment system for treating human waste wherein human waste is received in a holding tank having a motor-activated grinder pump associated therewith comprising:

sensing means associated with said holding tank adapted to detect the presence of a tablet of a predetermined size, shape and weight introduced into said holding tank along a confined path leading into said holding tank and having a pair of spaced contacts electrically connected to said motor-activated grinder pump along said confined path adapted to be contacted by said tablet to thereby close said contacts and activates said grinder pump.

7. The system of claim 6 wherein said substance is a tablet of dry concentrated chlorine of a configuration and weight sufficient to momentarily close said spaced contacts.

8. In the system of claim 6 wherein said sensing means includes a chute opening at the bottom thereof into said holding tank and having access thereto from outside of said toilet, said spaced contacts being disposed within said chute in location adapted to be contacted by said tablet passing therethrough.

9. The system of claim 8 wherein said substance is a tablet of dry concentrated chlorine of a configuration and weight sufficient to close said spaced contacts as it passes through said chute to said holding tank.

10. A treatment system for treating human waste wherein human waste is received in a holding tank having a grinder pump associated therewith activated by a motor comprising:

sensing means associated with said motor adapted to activate said motor to thereby actuate said grinder pump when the presence of a tablet of a predetermined size, shape and weight introduced into said system is detected.

* * * * *